United States Patent [19]

Abedor et al.

[11] 4,371,071

[45] Feb. 1, 1983

[54] TOKEN SENSING PHOTODETECTOR ACTUATED ELECTRONIC CONTROL AND TIMING DEVICE AND METHOD OF USE

[76] Inventors: Allan J. Abedor; John L. Abedor, both of 865 Virginia Ave., East Lansing, Mich. 48823

[21] Appl. No.: 257,009

[22] Filed: Apr. 24, 1981

[51] Int. Cl.[3] ..... G07F 7/00

[52] U.S. Cl. ..... 194/4 R; 40/27.5; 194/4 F; 194/97 R; 250/223 R; 250/578; 356/435; 434/238

[58] Field of Search ..... 40/27.5; 194/4 C, 4 E, 194/4 F, 4 G, 4 R, 97 A, 97 R, 99, 102; 250/219, 221, 223 R, 578; 356/239, 435; 434/238

[56] References Cited

U.S. PATENT DOCUMENTS

| | | | |
|---|---|---|---|
| 2,016,036 | 9/1935 | Fitz Gerald . | |
| 2,131,091 | 10/1935 | Binks . | |
| 2,237,132 | 4/1941 | Christensen . | |
| 2,539,855 | 1/1959 | Nelson | 194/97 R |
| 2,840,213 | 6/1958 | Gilmour | 434/238 |
| 3,012,666 | 12/1961 | Cox . | |
| 3,290,796 | 12/1966 | Gurda | 434/238 |
| 3,421,009 | 1/1969 | Caruthers | 250/578 |
| 3,473,036 | 10/1969 | Marcus . | |
| 3,480,785 | 11/1969 | Aufderheide . | |
| 3,491,234 | 1/1970 | Tsugami . | |
| 3,496,370 | 2/1970 | Haville et al. . | |
| 3,497,304 | 2/1970 | Berube . | |
| 3,541,339 | 11/1970 | St. John et al. . | |
| 3,679,314 | 7/1972 | Mustert . | |
| 3,807,875 | 4/1974 | Fischer . | |
| 3,921,003 | 11/1975 | Greene . | |
| 4,015,121 | 3/1977 | Gagnon . | |
| 4,075,507 | 2/1978 | Pauli . | |
| 4,082,188 | 4/1978 | Grimmell . | |
| 4,089,400 | 5/1978 | Gregory . | |
| 4,136,961 | 1/1979 | Young . | |
| 4,157,139 | 6/1979 | Bjork | 209/580 |
| 4,172,222 | 10/1979 | Eglise . | |
| 4,267,916 | 5/1981 | Black et al. | 194/102 |

*Primary Examiner*—Joseph J. Rolla

*Assistant Examiner*—Jan Koniarek

*Attorney, Agent, or Firm*—Ian C. McLeod

[57] ABSTRACT

The Token Sensing Photodetector Actuated Electronic Control and Timing Device (TSPAECTD) is a self contained unit which can control the activation and time of operation of any electrical appliance, device, machine or process to which it is connected. This control is effected by means of detecting the authenticity of a colored translucent object (token) inserted into the apparatus housing. The apparatus is electronically adjusted to detect only an object or token having a particular combination of size, shape, color, hue, reflectivity and light absorbancy. The TSPAECTD includes an improved photodetector circuit containing at least two monochromatic light sources and corresponding photodetectors aligned as pairs. Each pair is connected to a comparator integrated circuit containing four comparator subcircuits. These four comparator subcircuits are electronically adjusted to produce a desired output state only when they detect a particular photodetector voltage within a very narrow range that is produced only when a genuine object (token) is positioned between the monochromatic light sources and their corresponding photodetectors. Thus when a genuine object (token) is inserted into the apparatus housing, it moves by gravity through a positioning means to a position where it will momentarily but simultaneously intercept the monochromatic light from at least two light sources. The color, hue, reflectivity and light absorbancy of the token will attenuate the current output of each photodetector a predetermined amount as the token passes between the light and its corresponding photodetector. The comparator subcircuits, having been previously adjusted to detect only the voltage produced when a genuine token passes between a monochromatic light source and its corresponding photodetector, will produce a desired output state. If and when all four comparator subcircuits produce the desired output state simultaneously, an AND gate means is activated, the output of which preferably activates a timer means which in turn activates an on-off switch means to the main power of any electrical appliance, device, machine or process connected to the on-off switch means. A timer means is provided between the AND gate means and the on-off switch means to regulate the activation to deactivation time period of any appliance, device, machine or process connected to the switch means.

22 Claims, 4 Drawing Figures

TOKEN SENSING PHOTODETECTOR ACTUATED ELECTRONIC CONTROL AND TIMING DEVICE AND METHOD OF USE

BACKGROUND OF THE INVENTION

1. Field of the Invention

The present invention relates to an apparatus with an improved photodetector circuit activated by colored translucent objects and which provides highly selective detection between objects of different color, hue, reflectance and light absorbance. The present invention particularly relates to an apparatus containing a circuit which detects a gravity fed moving colored translucent disc as the object which is inserted into the inside of a closed housing.

In the present invention, detection of a genuine object or token requires that at least two monochromatic light source/photodetector pairs, when simultaneously sensing light transmitted through the translucent token, produce a voltage within their respective comparator circuits which is within a very narrow present range such that desired comparator output voltages are produced. If and when all comparators reach the desired output voltages simultaneously, an AND gate means produces a "high" output voltage which actuates a timer means and an on-off switch means which controls the activation and time period to deactivation of any electrical appliance, device, apparatus, machine or process connected to the on-off means.

Objects (tokens) having a very wide range of color, hue, reflectivity, light absorbance and combinations thereof can be accurately and reliably detected by this apparatus. Moreover, the apparatus is very easily adjusted to detect objects (tokens) of widely varying color, hue, reflectivity, absorbance and combinations thereof by simply adjusting potentiometers determining comparator integrated circuit reference voltages. Objects of varying physical size and shape can be accommodated for detection by altering the token pathway within the apparatus to an appropriate size and shape.

A method of using the apparatus is also described. The apparatus and method are particularly useful for controlling activation and deactivation of appliances, devices, machines or processes connected thereto by means of genuine objects (tokens) given to potential users as a reward for desired services or behavior.

2. Prior Art

The prior art has generally described the use of photocells in a variety of detection apparatus. Illustrative are U.S. Pat. Nos. 2,016,036; 2,131,091; 2,237,132; 3,807,875; 3,012,666; 3,473,036; 3,541,339; 3,921,003; 4,015,121; 4,075,507; 4,082,188; 4,089,400; 4,136,961; and 4,172,222. In many of these devices, the position of specific patterns or features of coins or other objects was detected by means of light passing by, reflected from or transmitted through the object being interrogated. None of these devices, however, appear to have provided reliable and precise detection of transmitted light through a selected moving colored translucent object.

Prior art also described various apparatus including photoelectric comparator circuits which detect color and/or position of specific patterns or features by means of light transmitted through and/or reflected from a genuine bank note or other translucent object in order to determine authenticity. Illustrative are U.S. Pat. Nos. 3,480,785; 3,491,234; 3,496,370; 3,497,304 and 3,679,314.

Such photodetector circuits do not accurately and reliably detect the genuineness of a selected, moving colored, translucent object; nor are they easily adjustable to detect selected moving translucent objects having a wide variety of optical characteristics such as variations in color, hue, reflectance and light absorbance. There was a need, therefore, to provide an improved photodetector circuit which would accurately and reliably detect the genuineness of a selected moving translucent object; and also which would be easily adjustable so that genuine translucent objects having a wide range of colors, hue, reflectance and light absorbancy could be accurately and reliably detected.

OBJECTS

Therefore, it is an object of the present invention to provide an apparatus, including a photodetection circuit, which accurately and precisely detects the genuineness of a moving, colored, translucent object having a particular color, hue, reflectance and absorbance.

Further, it is an object of the present invention to provide an apparatus which is only activated by a genuine moving translucent object and which can be easily adjusted to allow accurate and reliable detection of genuine objects having widely differing colors, hue, reflectivity, light absorbancy, and any permutation or combination of these properties.

Further still, it is an object of the present invention to provide an apparatus including a photodetection circuit which provides for the control of the period of activation of any electrical appliance, device, machine or process through a timer means and a switch means connected to a main power line; the timer and switch means being activated through detection of a genuine object or token.

Finally, it is an object of the present invention to provide a method for the use of the photodetector controlled apparatus.

These and other objects will become increasingly apparent by reference to the following description and to the drawings.

DESCRIPTION OF THE DRAWINGS

For the purpose of illustrating the invention, there are shown in FIGS. 1 through 4 an embodiment which is presently preferred, it being understood, however, that the invention is not limited to the precise arrangement and instrumentalities shown.

FIG. 4 includes a schematic drawing of the timing and control circuits including: a programmable timer integrated circuit, a relay driver circuit and a relay, such that when the timer is actuated by the AND gate, the timer begins a timing cycle and energizes the relay driver which actuates the relay, which thus controls the activation and time of deactivation of any appliance, device, machine or process whose main line or controlling subcircuit are connected to the relay (on-off switch means).

FIG. 4 includes a schematic drawing of the conventional six (6) volt DC regulated power supply which provides current to all electronic components in the interrogation, timing and control circuits.

GENERAL DESCRIPTION

Figure 1:
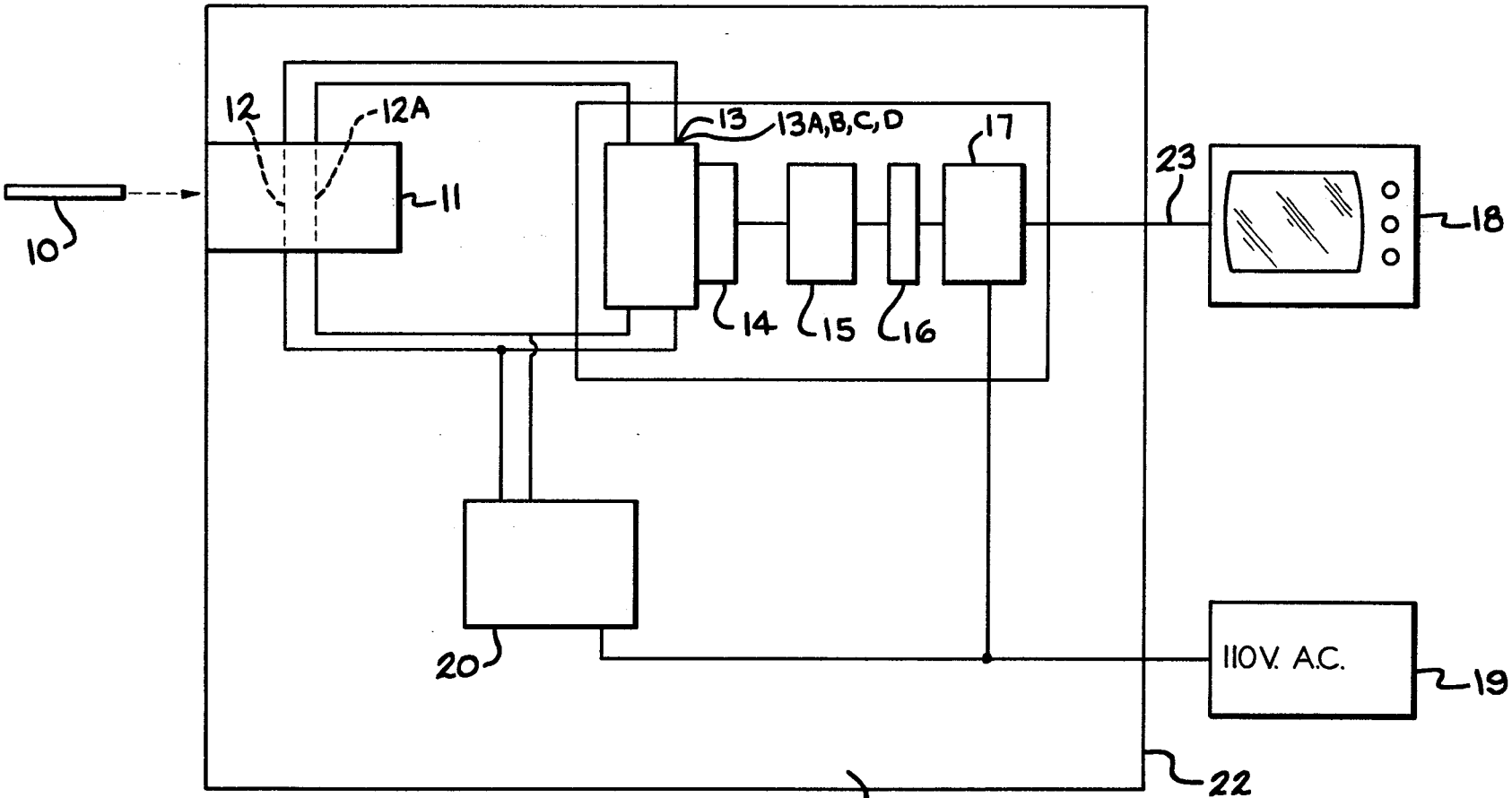
FIG. 1 is a functional block diagram and schematic of the present preferred embodiment of the apparatus illustrating the main functional electronic and physical components including: a housing (22); a genuine colored translucent token (10); a token pathway and positioning means (11); two monochromatic light source/photodetector pairs (12 and 12*a*); four comparator integrated circuits (13A,B,C,D); a wired AND gate circuit (14); a timer (15); relay driver circuit (16); a relay or triac on-off switch means (17); an electrical appliance controlled by the apparatus (18); an electrical power source into the apparatus (19); a 6 volt regulated power supply to provide necessary current to all electronic components of the apparatus (20), and an electrical connection between the appliance being controlled and the apparatus (23).

The present invention relates to the improvement in an apparatus and a method of controlling the activation and time period until deactivation of any electrical appliance, device, machine or process over which such control is desired. This control is affected by means of connecting the appliance main power line or a controlling subcircuit to a timer means and an on-off switch means within the apparatus. The timer means and on-off switch means are actuated by photoelectric detection of the authenticity of a colored, translucent object or token inserted into the apparatus housing. The apparatus is electronically adjusted to detect only genuine colored translucent objects (tokens) having a particular combination of optical characteristics of color, hue, light reflectance and absorbancy. A "main line" includes any voltage or current and also includes subcircuits.

In a preferred embodiment, the apparatus includes the following components:

(1) a housing which provides (a) a mounting for all electronic components; (b) a pathway or slot into which objects (tokens) are inserted and moved by gravity through interrogation and into storage; (c) a repository for used objects (tokens); and (d) a locking door through which used objects can be recovered from the repository for reuse.

(2) colored translucent objects (tokens) resembling discs in shape with two parallel sides and having a particular combination of color, hue, reflectivity, light absorbancy, size, shape and thickness are designated as "genuine" or "authentic".

(3) a photodetection circuit including: (a) at least two spaced apart monochromatic light sources mounted in the housing pathway which are capable of transmitting radiation through the object; (b) at least two photodetectors mounted in the housing pathway directly opposite the light sources so as to receive light from only one monochromatic light source. In this way the light source and its photodetector are considered as a pair.

(4) a positioning means (pathway) within the housing for transporting the translucent colored objects by gravity to a precise position between both monochromatic light sources and their respective photodetectors such that only an object of the proper (authentic) size and shape can momentarily but simultaneously intercept and attenuate the radiation from both monochromatic light sources.

(5) a voltage comparator circuit including: (a) four separate comparator subcircuits, two of which are connected to the photodetector of one light source/-photodetector pair, and the other two comparators are connected to the photodetector of the other light source/photodetector pair; (b) means for electronically adjusting the comparator subcircuits so as to produce a desired output state only when a specific photodetector voltage (within a very narrow range) is detected that is produced only when a genuine object or token is positioned between a monochromatic light source and its photodetector.

(6) an AND gate circuit connected to the four comparator subcircuits such that only when all four comparator subcircuits are simultaneously in the desired output state with the AND gate circuit produce a "high" output voltage which will, in turn, actuate the timing circuit.

(7) a timing circuit to accurately regulate the activation and deactivation time period of any appliance connected to the on-off switch means, and which includes a programmable (variable) timing integrated circuit, the output of which is connected to a relay driver circuit, which, in turn, actuates the on-off switch (relay or triac) across which is connected the main line or controlling circuit of an appliance over which control is desired.

(8) a relay or triac circuit actuated by the timing and relay driver circuit which functions as an on-off switch for any appliance, device, machine or process connected thereto.

(9) a regulated power supply circuit, connected to an external 110VAC or 220VAC main power line, such that the 110VAC or 220VAC is regulated to 6VDC to provide proper operation of all electronic circuits of the apparatus.

The present invention also relates to an improved method for controlling an electrical main line or subcircuit through use of a selected authentic colored translucent object or token which is detected by a photoelectric detection circuit which, in turn controls an on-off switch means in the main line or subcircuit. The improved preferable method includes:

(1) providing an object or token having a specific combination of color, hue, reflectivity and light absorbancy, size and shape, and which is denoted as an authentic or genuine object or token;

(2) providing at least two spaced apart monochromatic light sources mounted in a housing so as to provide light from the sources through an authentic object or token when positioned in the housing:

(3) providing at least two photodetectors mounted in the housing directly opposite the light sources so as to receive light from only one monochromatic light source such that a light source and a photodetector are considered as a pair;

(4) providing a positioning means within the housing which transports the object by gravity to a precise position between both monochromatic light sources and their respective photodetectors such that an object of the proper (authentic) size and shape can preferably momentarily but simultaneously intercept and attenuate the radiation from both monochromatic light sources;

(5) providing a voltage comparator circuit including four independent comparator subcircuits such that two are connected to a first light source/photodetector pair and two are connected to the second light source/-photodetector pair;

(6) electronically adjusting the reference voltages of all four comparator subcircuits so that each produces a desired output state when they detect the presence of an authentic object or token. Detection is accomplished by means of comparing the preset comparator reference voltages with the voltages produced by each photodetector circuit when an authentic object is positioned so as to intercept and attenuate the radiation from both monochromatic light sources simultaneously. If the photodetector circuit voltage(s) are within the very narrow range of preset reference voltages, the comparators will produce the desired output state. (A complete description of comparator adjustment and operation is provided in the detailed description).

(7) providing an AND gate circuit that, when sensing the desired output state simultaneously occurring in all four comparator subcircuits, will produce a "high" output voltage;

(8) providing a programmable timing circuit actuated by a "high" output voltage from the AND gate circuit, which, when beginning a timing cycle will actuate a relay driver circuit, which in turn will actuate the on-off switch means (relay or triac);

(9) connecting the main line of any electrical appliance, device, machine or process to the on-off switch means;

(10) adjusting the programmable timing circuit for the length of time desired for main line or subcircuit operation;

(11) providing a regulated power supply connected to an electrical main line to energize all electronic components/circuits; and

(12) inserting an authentic object or token into the positioning means so as to actuate the on-off switch means and thus control the activation and time to deactivation of the main line or subcircuit of the appliance, device, machine or process.

The present invention also relates to a method of inducing desired behavior from an animal or human by controlling electrical power in a main line to an appliance which comprises:

(a) identifying an appliance the use of which humans or animals consider desirable, satisfying, rewarding or beneficial;

(b) providing an apparatus which is capable of actuating the identified appliance by means of insertion of colored, translucent discs, and which will terminate appliance operation after a predetermined length of time;

(c) connecting the identified appliance to the on-off switch means within the apparatus so that appliance activation occurs only when a genuine disc is inserted in the apparatus and deactivation occurs automatically after a preset length of time;

(d) indicating, demonstrating, or communicating to a human or animal user exactly what behavior is desired and the number of discs which will be given as a reward for the desired behavior;

(e) after the desired behavior has been performed, provide the human or animal user the predetermined number of discs as a reward for the desired behavior, wherein the user can then feed the discs into the apparatus housing to thereby activate the selected appliance for a predetermined length of time and whereby reactivation of the appliance will require insertion of another disc.

As shown in the schematic block diagram in FIG. 1, an authentic colored translucent token 10 is inserted into the positioning means 11 where it moves by gravity to a position where it will momentarily but simultaneously pass between both monochromatic light sources and their respective photodetectors 12 and 12*a*. As the token passes between a light source and its photodetector, the combination of color, hue, reflectivity and absorbancy of the authentic token 10 will attenuate the intensity and alter the wavelength of the light transmitted through the token 10 which will attenuate the output current of the photodetector in each pair 12 and 12*a* a corresponding amount. A comparator integrated circuit 13 consisting of four independent comparator subcircuits 13*a, b, c,* and *d*, having been previously adjusted to produce a desired output state when they detect a photodetector circuit voltage within a very narrow range that is produced only when an authentic token 10 is attenuating the radiation from the monochromatic light sources, will each produce the desired output state. If and when all four comparator subcircuits 13*a, b, c,* and *d* produce the desired output state simultaneously the AND gate circuit 14 is actuated which in turn actuates a relay driver circuit 16, which in turn actuates a relay 17 which activates appliance 18 powered by electrical power source 19. The monochromatic light source/photodetector pairs 12 and 12*a*, the comparator IC 13 and its four subcircuits 13*a, b, c,* and *d*, the AND gate circuit 14, the programmable timer 15 and relay driver 16 and relay 17 constitute the electronic interrogation, control and timing system. All electronic circuits including the 6 volt DC regulated power supply 20 as well as the positioning means 11 and a used token repository 21 are contained inside the housing 22.

The Token Sensing Photodetector Actuated Electronic Control and Timing Device (TSPAECTD) is an independent unit which can control activation and time of operation of any electrical appliance, device, machine or process 18 whose main power 23 or controlling circuit is connected to the TSPAECTD on-off switch means or relay 17. Control over appliance 18 activation is obtained by means of detection of the authenticity of a colored, translucent object or token 10 having a predetermined combination of characteristics of size, shape, color, hue, reflectivity and light absorbancy. Operation of the apparatus and detection of an authentic token 10 requires that the 6VDC regulated power supply 20 be connected to a 110VAC power line 19 and that an authentic token be inserted in the positioning means 11 and moved by gravity to a position where it will be mechanically and electronically interrogated, automatically. When a genuine token has moved by gravity to a position where at least two monochromatic light source/phototransistor pairs 12, 12*a* simultaneously sense the radiation transmitted through the token 10 and produce a voltage within their respective comparator circuits 13*a, b, c,* and *d*, which is within a very narrow preset range, all comparators 13*a, b, c,* and *d* will produce a desired output state. When all four comparators 13*a, b, c,* and *d* simultaneously produce the desired output state, the AND gate circuit 14 will produce a "high" output voltage which will actuate a timer 15 (preprogrammed for a particular timing cycle, e.g., 30 minutes) which in turn actuates a relay driver 16 which then actuates a relay 17 (on-off switch) thus actuating the appliance 18 for the time period present in the timer 15.

The purpose of the TSPAECTD is to restrict the use of any electrical appliance, device, machine or process 18 to which it is connected to those personnel possessing an authentic token 10 having a predetermined combination of characteristics including size, shape, color, hue, reflectivity and light absorbancy. Assuming an electrical appliance 18, such as a television set is connected to the TSPAECTD, and assuming the comparator circuits 13*a, b, c,* and *d*, have been adjusted to produce a desired output state only when detecting a genuine token, the appliance 18 will not operate until a genuine token 10 is inserted into the positioning means 11. Once a genuine token 10 is inserted, an interrogation and timing cycle will begin enabling the appliance 18 to operate normally for a predetermined length of time as determined by the timer 15 after which the appliance 18 will be turned off automatically. The electrical appliance 18 can be reactivated for another timed cycle by insertion of another genuine token 10.

When the TSPAECTD is connected to an appliance, device, machine or process 16, the use of which is considered by humans or animals to be valuable, desirable, rewarding, important, or satisfying, the TSPAECTD provides a means of modifying human or animal behavior through selective award or withholding of tokens 10. For example, if the TSPAECTD is connected to a television set the use of which is desired by human subjects, desired types of behavior can be encouraged by awarding tokens 10 after the desired behavior has been demonstrated thus rewarding the subject for the desired behavior by enabling him/her to view the television for a specific length of time. Also undesirable behaviors can be reduced by withholding tokens 10 when undesirable behavior is observed. In effect, the awarding of tokens 10 and subsequent use of the desired appliance (e.g., a television set) is contingent upon the subject's demonstrating the desired behavior. The principle, procedures and research underlying the use of contingent rewards or reinforcers has been extensively described in the psychology literature, particularly the works on operant conditioning by B. F. Skinner (1957, 1968, 1971). Based on the principles of contingent rewards, a number of behavior modification programs have been developed in which the reward is a token which can later be exchanged for a variety of rewards such as candy, comic books, free time, or watching TV. In these programs, the subjects are told what behavior is expected (e.g., studying for 15 minutes) and what the reward will be (e.g., one token which can be exchanged for a comic book). Such token economies and their use in school systems, homes for delinquents, and other institutional settings have been described in Gage and Berlyner (1975), Kolesnik (1975), and Krumbholtz and Krumbholtz (1972). In the case of the present invention, subjects would be told what behavior was desired; an appliance considered rewarding to the subject would be attached to the TSPAECTD; then tokens 10 would be awarded for the specified behavior which would then enable the subject to operate the appliance, such as a TV, for a predetermined length of time. Additional instances of the desired behavior would earn the subject additional tokens 10 which could then be redeemed for additional appliance 18 use. In this way, desired behaviors could be obtained and gradually become part of the normal behavioral repertoire of the subject.

Figure 3:
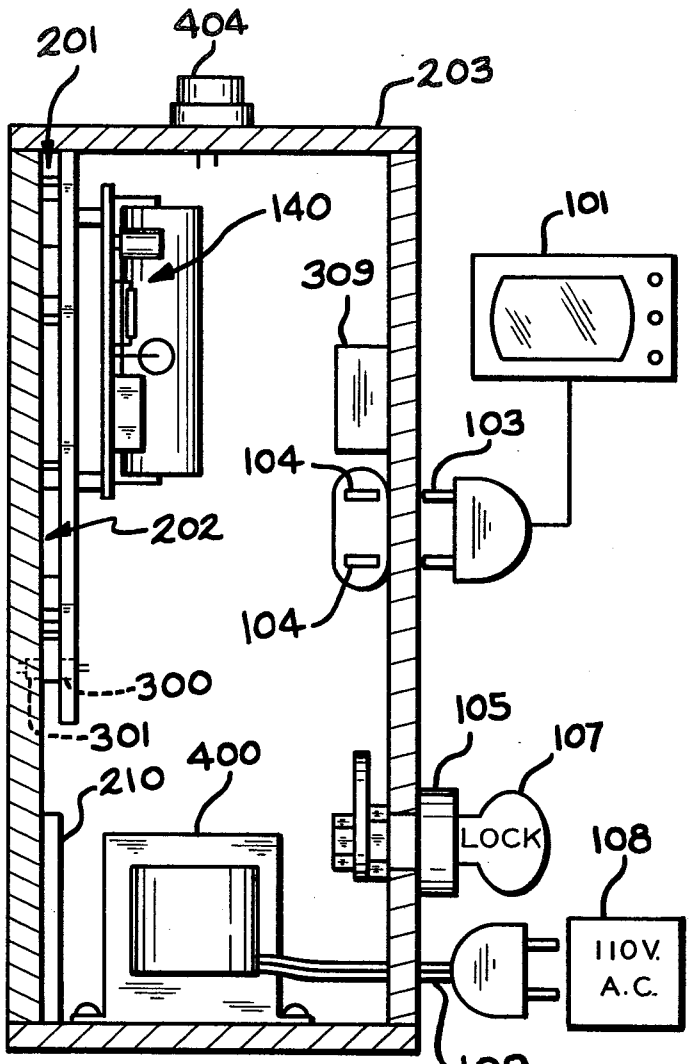
FIG. 3 is a front view cross section of the preferred embodiment of the apparatus along line A—A in FIG. 2 illustrating the mounting of the two monochromatic light source/photodetector pairs within the token pathway such that only tokens of proper thickness and diameter can proceed down the pathway, by gravity, and be simultaneously interrogated by both light source/-photodetector pairs. Also illustrated in FIG. 3 are other functional components of the apparatus including: a printed circuit board containing the major electronic circuits of the apparatus (140); the lock (105) and key (107) for controlling the opening of the sliding door (106) for removal of used tokens from the housing for reuse; and a female receptacle (104) into which is connected the main power line or a controlling subcircuit of an appliance to be controlled.
Figure 2:
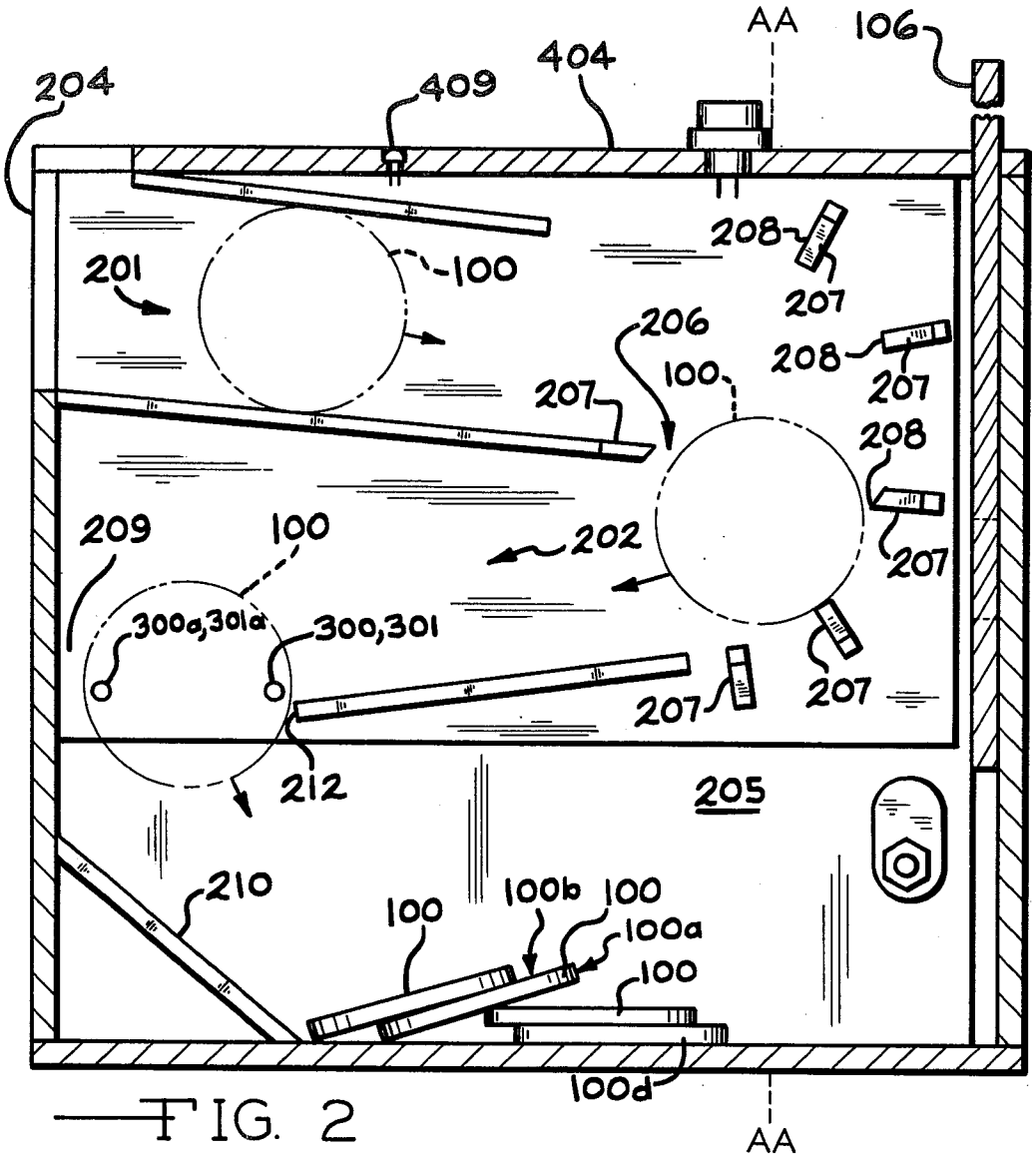
FIG. 2 is a side cross-sectional view of the current embodiment of the apparatus of the invention illustrating the mounting of the two monochromatic light source and photodetector pairs, positioned so that only a colored translucent disc (token) of the proper size (diameter and thickness) can traverse the token pathway and be simultaneously interrogated by both light source/photodetector pairs, and wherein the token pathway in the housing changes direction and includes several deflectors to prevent unauthorized retrieval of tokens after insertion. Also illustrated in FIG. 2 is the token repository (205) in the bottom of the housing and the sliding door (106) which when unlocked allows retrieval and reuse of tokens.
Figure 4:
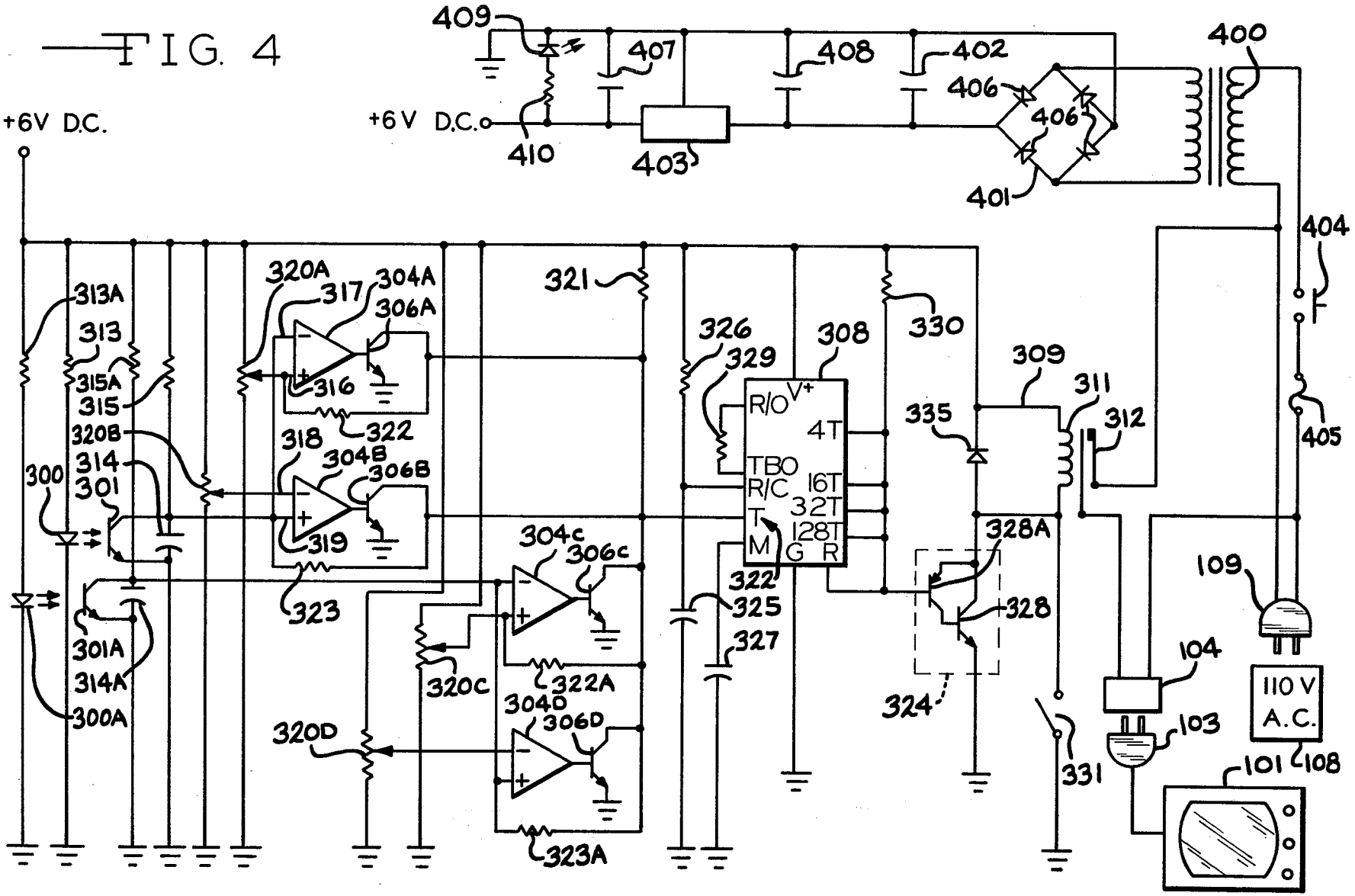
FIG. 4 is a schematic drawing of the electronic interrogation system of the invention showing various circuit components including: a photodetection component consisting of two monochromatic light sources and corresponding phototransistors aligned so as to form two pairs so both pairs can simultaneously detect a colored translucent object positioned between them, a comparator integrated circuit having four independent comparator subcircuits which are individually adjusted to detect a voltage within a very narrow range of that produced when a genuine object is positioned between a light source and its corresponding phototransistor, and when detecting such a voltage produces a desired output state; a wired AND gate which produces an output voltage only when all four comparator subcircuits are simultaneously in the desired output state.

The following description relates to the preferred apparatus of FIGS. 2 and 3 which is activated by a colored translucent disc or token with the electrical circuits shown in FIG. 4.

Any 110–220 volt, line powered electronic or electromechanical appliance, device, apparatus, machine or process 101 over which control is desired must be connected to the relay 309 (which functions as an on-off switch) of the TSPAECTD. In the preferred embodiment, this connection is made by inserting the main A.C. power cord 103 from the appliance, device, machine or process to be controlled 101 into a female receptacle 104. The female receptacle 104 is normally inaccessible within a housing 203, becoming accessible only through unlocking a lock 105 controlling a sliding door 106 in the housing 203 by means of a key 107. After inserting the main A.C. power cord 103 into the female receptacle 104, the sliding door 106 is closed and locked by lock 105, thus preventing unauthorized attempts to disconnect the appliance from the TSPAECTD.

The TSPAECTD is connected to any standard 110/220 power source 108 by means of a standard male power cord 109. The TSPAECTD contains an integral regulated six (6) volt direct current power supply, shown in FIG. 4, which when connected to an A.C. power source 108, and when turned on by means of an on-off switch 404, supplys the necessary voltage and current to all electronic components and circuits of the apparatus. The TSPAECTD may be used either on 110 or 220 volts A.C. provided that the appropriate transformer 400 is included in the power supply circuit. However, the A.C. voltage used by the appliance being controlled 101 and the TSPAECTD A.C. power source voltage 108 must be the same, i.e., either 110 or 220 volts A.C.

Assuming that the TSPAECTD is connected to a suitable A.C. power source 108, that the TSPAECTD power switch 404 is on, that an appliance 101 is properly connected to the female receptacle 104, the appliance may be turned on by means of its own on-off switch, but no current will flow into the appliance 101 until a genuine colored translucent token 100 is detected by the electronic interrogation circuit. A genuine token 100 is one having:

(a) the specific combination of color, hue, reflectivity and light absorbancy for which the electronic interrogation system of FIG. 4 has been adjusted to detect; and (b) the proper size, shape and thickness needed to pass, by means of gravity only, through the mechanical interrogation and positioning means 204, 201, 202, 206 and 209 of the TSPAECTD.

A token 100 interrogation and appliance 101 activation and timing cycle is automatically initiated by insertion of a genuine token 100 into entry way 204. After insertion, the token 100 rolls by gravity down a fully enclosed inclined plane pathway 201, falling through an aperture 206, then rolls down a second inclined plane pathway 202 in the opposite direction in a "V" shape. At the end of the second pathway 202, the token momentarily but simultaneously passes between both pairs of light sources 300 and 300*a* and their corresponding phototransistors 301 and 301*a*. The color, hue, reflectivity and light absorbancy of the token 100 will alter the wavelength and reduce the intensity of light transmitted through the token 100, thus attenuating the current output of each photodetector 301 and 301*a* to a particular value. The comparator subcircuits 304*a, b, c* and *d*, having been previously adjusted to detect only the voltage produced when a genuine token 100 passes between the light sources 300 and 300*a* and their corresponding phototransistor 301 and 301*a*, will each produce a desired output state, i.e., the integral output transistor stage 306*a, b, c* and *d* of each comparator subcircuit 304*a, b, c* and *d* will be off. Because the transistor stage 306*a, b, c* and *d* of each comparator subcircuit 304*a, b, c* and *d* are wired together and connected to a pullup resistor 321 the resulting wired AND gate will output a "high" voltage. This "high" output voltage actuates a programmable timer integrated circuit 308, which in turn actuates relay driver transistors 328 and 328*a* which in turn actuate the coil 311 of the relay 309, which in turn allows A.C. power to flow into the appliance 101. The appliance 101 operates normally until the end of the timing cycle. At that time, the timer IC 308 will reset which will de-energize the relay driver transistors 328 and 328*a* which will then de-energize the relay coil 311 of the relay 309, thus stopping A.C. power flow into the appliance 101. The appliance 101 can be re-activated by inserting another genuine token 100 and beginning another interrogation and timing cycle.

A. TOKENS 100

A token 100 of 0.125" in thickness and 2.00" in diameter is used in the initially selected embodiment because this size would be too large for a young child to accidentally swallow, and also this size provides sufficient mass to propel the token 100 through the entry way 204, the inclined pathways 201 and 202 and aperture 206 and 209 by means of gravity alone, and is a size convenient to manufacture. With appropriate modifications to entry way 204, inclined pathways 201 and 202 and aperture 206 and 209, the TSPAECTD could also be used with circular tokens 100 of various thicknesses (between about 0.0625" and 0.250") and various diameters (about 0.50" to 3.00").

A preferred token 100 material is colored translucent plastic because this material is available in a wide variety of colors, hues, reflectivity, light absorbancy thickness and combinations thereof. And since the TSPAECTD electronic interrogation circuit can be adjusted to detect any combination of color, hue, reflectivity and light absorbancy, individual TSPAECTD units used in the same institutional or home setting can be adjusted to respond to vastly different tokens. Plastic is also relatively inexpensive and easily manufactured into the desired shape.

Once inserted inside the TSPAECTD, token 100 can be re-used simply by removing them from the token 100 repository 205 in the bottom of the housing 203. Access to the repository is made by means of unlocking the lock 105 with key 107 and raising the sliding door 106 in the housing 203. After tokens are removed, the sliding door 106 is again closed and locked.

B. MECHANICAL INTERROGATION OF TOKENS 100

A system for mechanical interrogation of tokens 100 is integral to the TSPAECTD housing 203 and is designed to prevent counterfeit tokens from being used and to prevent unauthorized recovery of genuine tokens after use. The mechanical interrogation system also functions as a positioning means to move the token by gravity to a position where it can be accurately interrogated by the electronic interrogation system. The mechanical interrogation and positioning system consists of an entry way 204, two inclined plane enclosed pathways 201 and 202, a precision aperture 206 and 209 and a series of deflectors 207. When a genuine token 100 of 0.125" thickness and 2.00" diameter is inserted into the token 100 entry way 204, it rolls by means of gravity, down an inclined plane enclosed pathway 201 approximately 6 inches long. Both the entry way 204 and pathway 201 are manufactured to close tolerances so that the maximum size token 100 that can be accepted without jamming is 0.135" thick and 2.10" in diameter. Thus any oversize, counterfeit tokens will be immediately rejected and if forced into the entry way 204 or further forced into the pathway 201, will jam the pathway 201 and prevent further use of the TSPAECTD and any electrical appliance 101 connected to it.

If a genuine size (or smaller) token 100 is inserted, it enters the first of two fully enclosed inclined plane pathways 201. The inclination of pathway 201 is approximately 25 degrees below horizontal which enables the token 100 to roll, by means of gravity only, to the end of the first enclosed pathway 201. At the end of the first pathway 201 is a precision aperture 206 formed by several deflectors 207 placed at precise distances from one another. The deflectors 207 are tapered on one end 208 in order to capture or jam any device (such as thread or small wire) that is used to recover a genuine token 100 after it has been inserted and started a timing cycle of the electrical appliance 101 being controlled.

Genuine tokens 100 rebound off the deflectors 207 and pass through the precision aperture 206, falling by gravity into the second leg of the pathway 202. The direction of token 100 travel in the second leg 202 is approximately 130 degrees different than the direction of travel in the first leg 201. This change in direction is intended to preclude retrieval of a genuine token after a timing cycle has started by means of turning the housing 203 upside down. Furthermore, this change in direction makes it difficult, if not impossible, for genuine tokens 100 to traverse both legs 201 and 202 with a string or wire attached (not shown) for illicit recovery.

The second leg 202 forms an inclined plane of 25 degrees below the horizontal. The inclination of leg 202 thus enables the token 100 to roll, by gravity, to aperture 209 at the end of the pathway 202 where are located the two light source/phototransistor pairs 300, 301, 300*a* and 301*a*, geometrically spaced apart such that only a token of 2.00" diameter can be simultaneously interrogated by both light source/phototransistor pairs 300, 301, 300*a* and 301*a*. Thus if a counterfeit token which is smaller in diameter than 2.00" is inserted and rolls by gravity to the end of the second leg 202, the pairs 300, 301, 300*a* and 301*a* are horizontally spaced far enough apart so they cannot simultaneously respond to an undersize token (not shown). A genuine token 100, after passing the light source/phototransistor pairs 300, 301, 300*a* and 301*a*, will fall downward by gravity through aperture 209 and strike a plate 210, which deflects the tokens 100 into repository 205.

C. ELECTRONIC INTERROGATION SYSTEM

After successful negotiation of the mechanical interrogation system defined by entry way 204, legs 201 and 202, and aperture 206 and 209, a genuine token 100 will, at the end of leg 202 be automatically positioned for electronic interrogation as generally discussed in relation to FIG. 1 and as shown in FIGS. 4 and 5. The output of the electronic interrogation system determines whether any appliance 101 connected to the TSPAECTD will be activated.

The interrogation circuit as shown in FIG. 4 is a means for accurately and reliably detecting a token 100 having a specific combination of optical properties; i.e., color, hue, reflectivity and light absorbancy. The electronic interrogation circuit consists of two distinct subsystems: (1) two monochromatic light sources 300 and 300*a* aligned with two corresponding phototransistor units 301 and 301*a*; and (2) a voltage comparator circuit including four independent comparator subcircuits, 304*a*, 304*b*, 304*c* and 304*d*, with a wired AND gate function.

Two pairs of light source units 300 and 300*a* and phototransistors 301 and 301*a* are used for transducing light intensity changes into voltages which are interpreted by the comparator subcircuits 304*a*, 304*b*, 304*c* and 304*d*. Light intensity changes are caused when an object 100 of a particular color, hue, reflectivity and light absorbancy passes between a light source 300 and 300*a* and its corresponding phototransistors 301 and 301*a*. Each light source 300 and 300*a* consists of one light emitting diode (LED), for example a red gallium arsenide phosphide LED of approximately 1.8 milliwatts power dissipation, 2.0 mcd luminous intensity at 20 MA, with a 50 degree viewing angle, clear tint transparent lens, emitting a wavelength of 660 nanometers. The two phototransistors 301 and 301*a* are NPN silicon phototransistors of approximately 40 volts and 100 milliwatt capacity which are sensitive to the spectral range of the LED's 300 and 300*a*. Such a phototransistor 301 or 301*a* is the Motorola MRD 450$_{T.M.}$. The LED 300 and corresponding photo transistor 301 are installed facing each other in a housing approximately 0.250" apart so that the radiant energy emitted by the LED 300 will be sensed only by its corresponding photo transistor 301 and so that an object or token of less than 0.250" thickness can pass between them. LED 300 and its corresponding photo transistor 301 are considered a light detection pair. In a similar way, a second LED 300*a* and photo transistor 301*a* are installed in the housing facing each other, aligned and 0.250" apart, forming a second light detection pair. The two pairs, 300 and 301 and 300*a* and 301*a* are both installed in a housing formed by the end of leg 202 (FIG. 2) such that the two pairs are horizontally spaced apart approximately 1.75". One pair 300 and 301 is placed exactly at the entrance 212 to aperture 209 at the end of leg 202. The other pair 300*a* and 301*a* is installed approximately 1.75" horizontally away. This spacing of the two pairs is used to allow simultaneous detection of only tokens 100 having the proper diameter (2.00"). If a smaller token is used, it will intercept the first light detection pair 300 and 301, but gravity will cause it to fall into the aperture 209 before it intercepts the second light detection pair 300*a* and 301*a*. Since both pairs must simultaneously detect a genuine object for actuation of an appliance 101, and since an undersize (counterfeit) token cannot do so because of the horizontal spacing of the two pairs 300, 301 and 300*a*, 301*a*, all undersize counterfeit tokens will fall, by gravity through the aperture 209 into the token repository 205 without actuating the appliance 101.

The use of at least two horizontally spaced apart light source/phototransistor pairs 300, 301 and 300*a*, 301*a*, was also necessitated by the requirement for accurate token discrimination. For example, it was found that when using a single light source/phototransistor pair, that the edge of a counterfeit translucent or opaque token would, at some point, as the counterfeit passed between the single light source and its phototransistor, attenuate the light intensity to the same value as a genuine token. Thus with a single light source/phototransistor system, inaccurate interrogation would result unless the interrogation was delayed until after the edge had passed the light source. This "edge" problem was solved in the present invention by using at least two light source/photodetector pairs, connected to voltage comparators and an "AND" gate means such that both pairs must simultaneously sense the light intensity of a genuine token before appliance 101 activation can occur.

A $\frac{1}{2}$ watt, 100 ohm resistor 313 and 313*a* is installed in series with each LED 300 and 300*a* to limit current to a value within LED specifications. A 16 volt 0.047 mf capacitor 314 and 314*a* is connected across the terminals of each photo transistor 301 and 301*a* to reduce unwanted voltage oscillations. A 100,000 ohm $\frac{1}{4}$ watt resistor 315 and 315*a* is connected to the positive terminal of each photo transistor 301 and 301*a* to convert the current generated by the phototransistor 301 and 301*a* into voltage.

An LM 339 Quad Comparator$_{T.M.}$ integrated circuit containing four identical but independent comparator subcircuits 304*a*, 304*b*, 304*c* and 304*d* are used to determine if voltage produced by each independent LED/-photo transistor unit 300, 301 and 300*a*, 301*a* is within a very narrow reference voltage range or "window" as follows. Two comparator subcircuits 304*a* and 304*b* are connected to the first photo transistor 301, and the second two comparator subcircuits 304*c* and 304*d* are connected to the second photo-transistor 301*a*. Each comparator subcircuit 304*a*, 304*b* 304*c* and 304*d* has connected to it a corresponding 1K, 20 turn potentiometer 320*a*, 320*b*, 320*c*, and 320*d* which are used to set the reference voltage.

In comparator 304*a*, an arbitrary reference voltage is set by adjusting potentiometer 320*a*. This reference voltage is seen by the positive input 316 of the comparator 304*a*. The negative input 317 to comparator 304*a* sees the voltage from the first photo transistor 301. If the photo transistor 301 voltage is below the arbitrary reference voltage, the output transistor 306A of the comparator 304*a* will be off. (The desired output state). In comparator 304*b*, the connections are reversed. The positive input 319 of the comparator 304*b* sees the output voltage of the photo transistor 301 and the negative input 318 sees the arbitrary reference voltage set by potentiometer 320*b*. When the voltage output of the phototransistor 301 is greater than the reference voltage, the output transistor 306*b* of the comparator 304*b* is off (the desired output state).

If the reference voltage in comparator 304*a* is arbitrarily set higher than the reference voltage in comparator 304*b*, in order for both comparators 304*a* and 304*b* to produce the desired output state the voltage from the phototransistor 301 must be below the reference voltage of comparator 304*a* and above the reference voltage for comparator 304*b*. This range of reference voltage values is known as the "window" and in the present circuit the window width is preferably adjusted not to exceed 10 microvolts. The reference voltages of comparators 304*a* and 304*b* and the resulting "window" are adjusted by iserting a genuine token 100 between the LED 300 and its corresponding photodetector 301, so that the current produced by the photodetector 301 has been attenuated to that value corresponding to the intensity and wavelength of light transmitted through the genuine token 100. Then potentiometers 320*a* and 320*b*, are adjusted to provide the proper window width and the genuine token is then removed.

The second LED/phototransistor pair 300*a* and 301*a* is connected to comparator subcircuits 304*c* and 304*d* in exactly the same manner as described above. Moreover, the comparator 304*c* and 304*d* reference voltages are adjusted in the same manner as above by means of potentiometers 320*c* and 320*d*. Thus the optical interrogation circuit can be easily adjusted to detect tokens 100 having a wide range of colors, hues, reflectivity and light absorbancy and combinations thereof by adjusting the reference voltages forming the "window" for comparators 304*a* and 304*b* and then adjusting the second "window" formed by comparators 304*c* and 304*d*. These window reference voltages may be easily set and/or changed manually by adjusting the resistance of the ½ watt 1000 ohm potentiometers 320*a*, 320*b*, 320*c* and 320*d*.

The comparator circuit in FIG. 4 includes a wired "AND" gate function such that the output transistors 306*a*, 306*b*, 306*c*, and 306*d* of all four LM 339 comparator subcircuits 304*a*, 304*b*, 304*c* and 304*d* must be off simultaneously before timer 308, relay driver 328 and 328*a*, and relay 309 circuits are actuated. In effect, the AND gate function provides a logic system wherein only under certain conditions (i.e., all four comparator subcircuits 304*a*, 304*b*, 304*c* and 304*d* have simultaneously detected a genuine token) can the AND gate activate the timer 308, which in turn actuates the relay driver 328 and 328*a*, which in turn actuates the relay 309 which then energizes the main line A.C. voltage source of any appliance 101 connected thereto.

In the present circuit, the "AND" gate function is achieved in the following way. All four comparator subcircuits 304*a*, 304*b*, 304*c* and 304*d* have an integral grounded emitter open collector transistor 306*a*, 306*b*, 306*c* and 306*d* as the output stage. This transistor output stage 306*a*, 306*b*, 306*c* and 306*d* can be connected in a variety of ways, one of which is to provide the wired logic for an "AND" gate function. This wired "AND" gate function is achieved by connecting the integral output stage transistors 306*a*, 306*b*, 306*c*, and 306*d* to a single ¼ watt, 1000 ohm pullup resistor 321. Wired in this way, the integral output stage transistors 306*a*, 306*b*, 306*c* and 306*d* must be off simultaneously in order for a "high" output voltage to reach the timer 308 to initiate a timing cycle, thus providing an "AND" gate function.

When no token 100 is between LED 300 and its corresponding photo transistor 301 or between LED 300*a* and its corresponding photo transistor 301*a*, the current output of the photo transistors 301 and 301*a* will far exceed the upper limit of the comparator "window" formed by comparators 304*a*, 304*b*, 304*c* and 304*d*, hence no action will be taken. When a counterfeit token is interrogated, the current produced in the photo transistors 301 and 301*a* will be outside of the narrow "window" range of reference voltages set in the comparators 304*a*, 304*b*, 304*c* and 304*d*, hence no action will be taken. However, when a genuine token 100 passes between LED 300 and photo transistor 301 and simultaneously passes between LED 300*a* and its corresponding photo transistor 301*a*, the color, hue, reflectivity and light absorbancy of the token 100 will reduce the light intensity and alter the wavelength of light reaching the photo transistors 301 and 301*a*. (Photo transistors 301 and 301*a* will have differing sensitivity to different wavelength light, hence current produced by the photo transistors 301 and 301*a* is a function of both light intensity and wavelength). In effect, the light from LED 300 and 300*a* will be attenuated by the genuine token 100 to produce the current in photo-transistors 301 and 301*a* and have a voltage which falls within the narrow range of preset voltage values of the "windows" formed by comparators 304*a*, 304*b* and 304*d*, 304*d*. When the output of both photo transistors 301 and 301*a* simultaneously are within the window values established by all four comparators 304*a*, 304*b*, 304*c* and 304*d* the integral output transistors 306*a*, 306*b*, 306*c* and 306*d* will be off whereby the wired "AND" gate function will actuate the relay driver transistors 328 and 328*a* which will actuate the relay 309 activating the appliance 101.

The ½ watt, 100,000 ohm resistors 322 and 322*a*, and the ¼ watt 10 million ohm resistors 323 and 323*a* provide a hysterisis, or positive feedback to the comparators 304*a*, 304*c*, 304*b* and 304*d* respectively to speed up the switching action.

Timing Circuit

FIG. 4 shows an EXAR 2240$_{T.M.}$ Binary Programmable Timer integrated circuit 308 which is actuated by the comparator "AND" gate output and is used to energize and de-energize the relay driver transistors 328 and 328*a*, which actuate, in turn, the relay 309 which actuates the appliance 101. The EXAR 2240 timer 308 provides a variable but preset length of time of operation for any appliance 101 connected to the relay 309.

A time base oscillator, counter, and control logic elements (not shown) are integral to the EXAR 2240 integrated circuit. Connecting one or more counter outputs by means of wires of switches to the positive supply through a pullup resistor 330 will program, or multiply the basic timing cycle by factors of 2, 4, 8, 16, 32, 64 or 128, or any combination thereof. The length of the basic timing cycle is set by the values of the tantalum capacitor 325 which, in the present circuit is 16 volts, and 10 mf in value, and resistor 326 which in the present circuit is ½ watt, 1000 ohms. By varying the value of the timing resistor 326 and/or capacitor 325, the length of the basic timing cycle can be varied. Moreover, by programming different counter outputs, the basic timing cycle itself can be multiplied by factors of 2, 4, 8, 16, 32, 64, 128 or any combination thereof, so that a very wide range of time of operation of the appliance 101 can be obtained. In the present circuit, the values of the timing capacitor 325 and resistor 326 and the counter outputs selected provide a total timing cycle of 30 minutes.

The EXAR 2240 timer 308 timing cycle is initiated by a trigger votage from the wired "AND" gate to trigger pin 322 of the timer 308. During the timing cycle, the timer 308 provides an output voltage to an external relay driver circuit 328 and 328*a*, which causes the relay coil 311 to energize allowing the relay contacts 312 to close allowing main line A.C. current to flow into the appliance 101. At the end of a timing cycle, a reset signal is automatically produced in the timer 308 which automatically terminates the voltage output to the relay driver transistors 328 and 328*a* which causes the relay coil 311 to de-energize thus opening the relay contacts 312 causing cessation of A.C. power to the appliance 101. In addition, the timer 308 reset signal automatically resets all counters to zero so the timer 308 would then be in its standby state awaiting the next trigger pulse. The 0.01 mf capacitor 327, and the 22,000 ohm resistor 329, and the 10,000 ohm pullup resistor 330 are provided for proper circuit operation.

The output capacity of the timer 308 is not sufficient to continuously operate a relay 309 or triac (not shown) of the size needed to handle 110/220 VAC main line current needed for electrical appliance 101 operation. Therefore, a two transistor 328 and 328*a* relay driver circuit 324 is provided to amplify the timer 308 output current to the necessary level. The relay driver circuit 324 functions like a solid state switch controlled by the timer 308 output. When the timer 308 output is "low", (which corresponds to the timer's 307 triggered state), the transistors 328 and 328*a* switch on and allow the relay coil 311 to be energized. When the timer 308 output is "high" the transistors 328 and 328*a* switch off and de-energize the relay coil 311. A 1N914 diode 335 protects the relay driver 324 circuit against transient high voltages.

The relay 309 used in the present application is a low profile, printed circuit type having 6 volt D.C. coil, single pole, single throw contacts with a contact rating of 2. 5 amps. A Potter and Brumfield R-50-E2-X1-6V$_{T.M.}$ or equivalent relay 309 is suitable. A triac, or electronic relay (not shown) can be substituted for the electromechanical relay 309 described above. If appliances 101 having higher amperage demands than 2.5 are to be used with the TSPAECTD, then a relay or triac with sufficient amperage rating would need to be substituted.

Assuming proper adjustment of the comparators 304*a*, 304*b*, 304*c* and 304*d* proper connection of the appliance 101 to the relay 309, proper connection to the TSPAECTD to a 110 VAC power source 108 and the TSPAECTD main power switch 404 is on, when a genuine token 100 is inserted into entry way 204, all subsequent operations for appliance 101 activation and deactivation are completely automatic and performed electronically with no moving or mechanical parts, except the token 100 which rolls by means of gravity only down legs 201 and 202 through apertures 206 and 209 and into repository 205.

After an appliance 101 has been activated by detection of a genuine token 100, the timer 308 will automatically deactivate the appliance 101 after a preset period of time (e.g., 30 minutes). If it is desired to reactivate the appliance 101, it is necessary to insert another genuine token 100 into the entry way 204 to repeat the automatic interrogation and timing sequence. If during a timing cycle, it is desired to shut off the appliance 101, the main power switch 404 on the TSPAECTD housing 203 may be momentarily turned off, then back on. This interruption of power to the timer 308 will automatically reset the timer 308 to zero and de-energize the relay coil 311 thus opening the relay contacts 312 and deactivating the appliance 101.

If it is desired to discontinue the use of tokens 100 as the only means of controlling operation of an appliance 101, a manually controlled bypass switch 331 may be actuated. This switch 331 bypasses the entire interrogation, timing and relay driver circuits and actuates the relay coil 311 directly allowing the appliance 101 to operate normally as long as the bypass switch 331 is in the "on" position. The bypass switch 331 can only be activated by unlocking the lock 105 and opening the sliding door 106 far enough to obtain access to the switch 331 mounted on the side of housing 203. The purpose of the bypass switch 331 is to allow selected users to decide for themselves when tokens 100 will be necessary to activate an appliance 101. For example, parents may not wish to use tokens 100 during their own late night TV viewing, but may wish to use tokens 100 when their younger children wish to use the TV.

REGULATED POWER SUPPLY CIRCUIT

The TSPAECTD uses an integral power supply as shown in FIG. 4. This power supply is of conventional design using a transformer 400, rectifier bridge 401, capacitors 402, and an integrated circuit (IC) voltage regulator 403 to provide six volt regulated current to the TSPAECTD circuits.

The power supply operates as follows: 110 VAC current is obtained from main AC line 108 by means of male plug 109. Current flows through a single pole, double throw, 3 amp switch 404, and through a ¼ watt, 120 VAC fuse 405 into the primary windings of a 6.3 volts, DC, 1.2 watt transformer 400 and is transformed into 6.3 volts RMS. This 6.3 volts RMS is rectified to pulsating DC by a rectifier bridge 401 consisting of four, 1 watt rectifier diodes 406. The pulsating DC is then filtered by a 16 volt, DC 5000 micro farad (mf) capacitor 402. This voltage is then regulated to exactly 6 volts DC by a Motorola MC 7806$_{t.m.}$ three terminal positive voltage monolithic integrated circuit 403. Transient response is controlled through the use of a 0.1 mf capacitor 407 and a 0.47 mf capacitor 408. A 1.8 milliwatt light emitting diode (LED) 409 with a current limiting 100 ohm resistor 410 is wired in series with the power supply output to provide a visual indicator light when the power supply and other TSPAECTD circuits are energized.

FURTHER VERSIONS/MODIFICATIONS TO THE TSPAECTD

While the basic principle of the TSPAECTD electronic interrogation system is that of simultaneous light intensity sensing, by multiple detectors, of light transmitted through a moving translucent token, there are several system components that can be altered, at will, to allow great variability in the light being sensed while still maintaining precise detection. For example, one or more of the optical or physical characteristics of the tokens can be changed and the TSPAECTD adjusted to detect the changed (genuine) tokens. Moreover, one or a combination of components of the electronic interrogation circuit can be changed thus altering the circuit sensitivity to a particular configuration token. In effect, manipulation of token optical and physical characteristics combined with manipulation of electronic interrogation sensitivity characteristics is analgous to being able to change the combination on a lock, at will. The TSPAECTD token/interrogation system can thus be altered in an almost limitless number of permutations and combinations—which allows a particular interrogation system configuration and a particular token configuration to be tailored, or customized to each other. Thus one family, agency or institution could use one configuration of tokens to actuate several TSPAECTD's controlling several appliances—or could use TSPAECTD's adjusted to use different configuration tokens for different appliances.

The matching of a unique token configuration (i.e. combination of color, hue, reflectivity and absorbancy) with a unique configuration of electronic interrogation components is accomplished simply and easily by manually adjusting potentiometers 320*a*, 320*b*, 320*c* and 320*d*, so the two comparator "windows" are within 10 microvolts of the voltage produced by photodetectors 301 and 301*a* when the token is being interrogated—whatever its characteristics and whatever configuration is provided for electronic interrogation.

The following system components can be manipulated independently or in combination with each other to provide the permutations and combinations of token and electronic interrogation configurations unique to the TSPAECTD:

1. Changing the spectral response or sensitivity to various wavelength light, of the light intensity sensing device (photo transistor) by means of: (a) changing one or both photo transistors to units made of different materials or manufactured by different manufacturers (manufacturers specifications may be used to identify a particular photo transistor's sensitivity to various colors in the spectrum); and (b) interposing a colored glass or gelatin filter between one or both photo transistors and the corresponding light source. Either a or b above will alter the current output of the photo transistor in response to the light transmitted through a given token, hence would require readjustment or "tailoring" of the comparator "windows" for accurate token detection and appliance activation.

2. Using light sources having varying spectral outputs (different wavelength output), e.g., (a) different color LED's (red, green, yellow, clear, etc.); (b) infrared emitters; (c) incandescent bulb; (d) neon bulb; (e) fluorescent bulb; (f) placing various colors of gelatin filters over one or both of the light sources; (g) combinations of a through f. Obviously changing one or both light sources would alter the current output of the photo-transistor in response to the light transmitted through a given token, hence would require readjustment or "tailoring" of the comparator "windows" for accurate token detection and appliance activation.

3. Varying the intensity of one or both light sources by increasing or decreasing their operating current.

4. Arranging the electronic detection system to measure light refracted through the token at other than a perpendicular angle—either instead of or in addition to measuring light transmitted perpendicularly through the token.

5. Arranging the electronic interrogation system to measure light transmitted through the token, to a mirror, and reflected back through the token a second time, before interrogation by the sensor.

6. Varying the light absorbtion and wavelength transmission characteristics of the tokens (e.g., varying independently or in combination the thickness, color, hue, reflectivity and absorbancy).

7. Varying the physical dimensions of the token, (e.g., diameter, thickness, or changing to other shapes such as spherical, rectangular, etc. with appropriate changes in the token pathway and positioning means.

8. In the present embodiment, the TSPAECTD is a separate, discrete (rather than integral) device, so that it is portable and can easily be moved from one location to another to permit control and timing of electrical appliances, devices, machines and processes in different locations. However, the basic mechanisms and circuits of the TSPAECTD could be easily built into appliances, such as TV, radio, stereo, computers and electronic games, or other devices, machines or processes.

As can be seen, the apparatus of the present invention provides an effective means for control of a main electrical line. Numerous variations will occur to those skilled in the art and all are included within the scope of the present invention.

We claim:

1. In an apparatus for controlling an electrical main line including an electrical circuit for controlling on-off switch means in the main line which is photoelectrically actuated by a colored translucent object with at least two sides through which light can pass the improvement which comprises:

(a) at least two spaced apart monochromatic light sources mounted in a housing so as to provide light from the sources through the object when positioned in the housing;

(b) at least two photoelectric detectors mounted in the housing so as to each receive light from only one of the light sources through the object such that a light source and a detector are coupled as a pair;

(c) positioning means within the housing for locating the object simultaneously between at least two of the light source and detector pairs;

(d) a voltage comparator circuit including at least four separate comparator subcircuits; at least two comparators responsive to a first photo detector/light source pair and at least two comparators responsive to a second photo detector/light source pair, all comparator subcircuits connected to a gate means such that when the object is simultaneously positioned between at least two photo detector/light source pairs, the light attenuated and transmitted through the object will produce a voltage within a very narrow reference voltage range simultaneously within all comparator subcircuits, thereby simultaneously producing a desired output state from each comparator and thereby actuating the gate means connected to the on-off switch means to thereby control the on-off switch means; and (e) electrical connection means to the main line, light source and detector pairs AND comparator circuit for providing electrical power.

2. The apparatus of claim 1 wherein the light source is a light emitting diode of a selected radiation frequency range capable of being attenuated by the translucent object and wherein the photoelectric detector is a photo-transistor having a spectral response within the radiation frequency range of the light emitting diode.

3. The apparatus of claim 1 wherein the on-off switch means is an electro-mechanical or electronic relay which is controlled by the comparator and gate circuits.

4. The apparatus of claim 1 wherein the connection means includes a receptacle for connecting an electrical appliance into the main line and plug connector means for providing 110 or 220 VAC power to the apparatus and wherein a regulated power supply reduces and rectifies the voltage and current to 6 VDC to power the light source and photodetector pairs, comparator circuit, gate circuit, and on-off switch means.

5. The apparatus of claim 1 wherein the positioning means in the housing includes a slotted labyrinth path for gravity feeding the object as a colored translucent circular disc of a specific size simultaneously past at least two of the light source and photodetector pairs to control the on-off switch means.

6. The apparatus of claim 1 wherein the comparator circuit includes an adjustable timer means activated by the gate means such that when activated, the timer actuates the on-off switch means and thereby controls the duration of power in the main line.

7. The apparatus of claim 1 wherein the housing is constructed to receive the object as a translucent disc which is gravity fed by the positioning means into the housing and simultaneously past two of the light source and detector pairs so as to actuate all of the comparator subcircuits as well as the gate means, timer means and on-off switch means.

8. The apparatus of claim 1 wherein the housing is constructed to receive a translucent object inserted in the positioning means adjacent to the light source and detector pairs in the manner of a key.

9. The apparatus of claim 1 wherein the housing encloses the light source and detector pairs, wherein the objects are inserted into the inside of the housing to turn on the on-off switch and wherein the housing has a lockable opening for controlled removal of the objects from the housing.

10. The apparatus of claim 1 wherein the reference voltage of each of the comparator subcircuits is adjustable by means of adjustable potentiometers such that reliable and accurate detection of translucent objects of different color, hue, absorbancy and reflectivity and combinations thereof can be obtained.

11. The apparatus of claim 1 wherein the positioning means in the housing has a slotted labyrinth path adapted to receive the object in the form of a translucent disc which is gravity fed inside the housing, wherein the slotted path is sized to reject discs of improper size and wherein the slotted labyrinth path is "V" shaped to prevent recovery or withdrawal of objects once inserted into the path.

12. The apparatus of claim 1 wherein the apparatus is portable.

13. The apparatus of claim 1 wherein the apparatus is integral to an appliance, device, or machine.

14. The apparatus of claim 1 wherein the gate means actuates a timer means which in turn actuates the on-off switch means and which controls the duration of actuation of the main line after the object is removed from between the light source and detector pairs and wherein the object causes a desired output voltage to occur in all comparator subcircuits.

15. The apparatus of claim 14 wherein the timer means is variable in duration and wherein the main line is connected to an electrical appliance which can be thereby actuated by the translucent object for a predetermined but variable period of time.

16. The method of inducing desired behavior from an animal or human by controlling electrical power in a main line to an appliance which comprises:

(a) identifying an appliance the use of which humans or animals consider desirable, satisfying, rewarding or beneficial;

(b) providing the apparatus of claim 1 which is capable of actuating the identified appliance by means of insertion of colored, translucent discs, and which will terminate appliance operation after a predetermined length of time;

(c) connecting the identified appliance to the on-off switch means within the apparatus so that appliance activation occurs only when a genuine disc is inserted in the apparatus and deactivation occurs automatically after a preset length of time;

(d) indicating, demonstrating, or communicating to a human or animal user exactly what behavior is desired and the number of discs which will be given as a reward for the desired behavior;

(e) after desired behavior has been performed, provide the human or animal user the predetermined number of discs as a reward for the desired behavior, wherein the user can then feed the discs into the apparatus housing to thereby activate the selected appliance for a predetermined length of time and whereby reactivation of the appliance will require insertion of another disc.

17. The method of claim 16 wherein the housing includes an adjustable timer means activated by feeding the disc into the housing which after a pre-selected period of time deactivates the power to the main line by turning off the switch means and wherein the appliance can only be reactivated by the user with a second colored, translucent disc identical to the first.

18. The method of claim 16 wherein the housing is adapted with a lock to prevent retrieval of discs from inside the housing by the user and wherein a person independent of the user with a key unlocks the housing to retrieve the discs.

19. The improved method for controlling an electrical main line using an electrical circuit for controlling on-off switch means in the main line which is photoelectrically actuated by a colored translucent object with at least two sides through which light can pass which comprises:

(a) providing electrical power to at least two spaced apart monochromatic light sources mounted in a housing so as to provide light from the sources through the object when positioned in the housing;

at least two photodetectors mounted in the housing so as to each receive light from only one of the light sources through the object such that a light source and photodetector are coupled as a pair;

positioning means within the housing for locating the object simultaneously between at least two of the light source and detector pairs;

a voltage comparator circuit including at least four separate comparator subcircuits, at least two comparators responsive to a first photodetector/light source pair and at least two comparators responsive to a second photodetector/light source pair; all comparator subcircuits connected to a gate means such that when the object is simultaneously positioned between at least two photodetector/-light source pairs, the light attenuated and transmitted through the object will produce a voltage within a very narrow reference voltage range simultaneously within all comparator subcircuits; thereby simultaneously producing a desired output state from each comparator thereby actuating the gate means connected to the on-off switch means to thereby control the on-off switch means to an electrically powered main line; and (b) positioning the object between the light sources and the detector pairs so as to actuate the on-off switch means.

20. The method of claim 19 wherein the selected object is a circular colored translucent disc which is provided to a user and wherein the disc is fed inside of the housing to turn on the switch means and actuate an appliance connected thereto in the powered main line.

21. The method of claim 20 wherein an adjustable timing means is connected between the gate means and the on-off switch means such that the timing means turns the switch means on, then off, as a function of time and wherein a second identical colored translucent disc is required to reactivate the switch means controlling the main line to an appliance.

22. The method of claim 20 wherein the user is a person or animal who is provided with the discs as a reward for desired behavior.

* * * * *